US006118359A

United States Patent [19]

Dittmann et al.

[11] Patent Number: 6,118,359

[45] Date of Patent: Sep. 12, 2000

[54] POLARIZED ELECTROMAGNETIC RELAY

[75] Inventors: Michael Dittmann; Jens Heinrich, both of Berlin; Heinz Stadler, Munich, all of Germany

[73] Assignee: Siemens Electromechanical Components & Co. KG, Munich, Germany

[21] Appl. No.: 09/325,869

[22] Filed: Jun. 4, 1999

[30] Foreign Application Priority Data

Jun. 4, 1998 [DE] Germany ..... 198 25 077

[51] Int. Cl.[7] ..... H01H 51/22; H01H 51/08

[52] U.S. Cl. ..... 335/78; 335/83; 335/79

[58] Field of Search ..... 335/78–86, 124, 335/128, 202

[56] References Cited

U.S. PATENT DOCUMENTS

| | | | |
|---|---|---|---|
| 4,695,813 | 9/1987 | Nobutoki et al. | 335/78 |
| 5,337,029 | 8/1994 | Nobutoki et al. | 335/78 |
| 5,617,066 | 4/1997 | Dittmann et al. | 335/78 |
| 5,673,012 | 9/1997 | Stadler et al. | 335/78 |
| 5,734,308 | 3/1998 | Dittmann et al. | 335/78 |

FOREIGN PATENT DOCUMENTS

| | | |
|---|---|---|
| 0197391 | 3/1986 | European Pat. Off. . |
| 19520220 | 11/1996 | Germany . |

*Primary Examiner*—Lincoln Donovan
*Assistant Examiner*—Raymond Barrera
*Attorney, Agent, or Firm*—Hill & Simpson

[57] ABSTRACT

A polarized magnetic relay has a base body, an armature, an envelope that encompasses insulating material, a coil, a core and a bar-shaped permanent magnet. The base plane is defined by the bottom side of a base body. The armature is arranged between two contact springs that lie parallel to each other in a common plane. Two transverse terminal webs, which have their sheet metal plane extending parallel to the base plane, extend out of the envelope in the area of the rotational axis of the armature and these terminal webs are respectively connected with a fastening tab that has its sheet metal plane extending perpendicular to the base plane. The contact springs exhibit two spring arms and a connecting web, respectively, which has its sheet metal plane extending perpendicular to the base plane. The spring arms exhibit a contact making part and a part that is embedded in the envelope. The part that is embedded in the envelope emerges into the connecting web.

17 Claims, 2 Drawing Sheets

POLARIZED ELECTROMAGNETIC RELAY

BACKGROUND OF THE INVENTION

1. Field of the Invention

The present invention is directed to a polarized electromagnetic relay with a base body comprising an insulating material, which defines a base plane with its bottom side, and in which terminal tracks for stationary contact elements as well as terminal elements for stationary and movable contact elements are embedded, a pivotable armature that is arranged above the base body, whose rotational axis runs parallel to the base plane and which is arranged between at least two contact springs of a contact spring group that is connected to the armature, which springs are arranged in a common plane and run parallel to each other so that the contact springs cooperate with the stationary terminal elements at the base body in response to the movement of the armature, an envelope that comprises insulating material which surrounds the contact springs in a central sector and from which two transverse terminal webs that are connected with the contact springs project in the area of the rotational axis of the armature, whereby the terminal webs, whose sheet metal plane extends parallel to the base plane, are respectively connected with a fastening tab, which has its sheet metal plane extending perpendicular to the base plane, a coil, whose axis runs parallel to the base plane and perpendicular to the armature and whose winding terminal elements pass perpendicularly through the base plane, a core that is arranged axially in the coil and to whose end pole shoes that are directed toward the armature connect and which form at least one working air gap with the armature and at least one bar-shaped permanent magnet, which is arranged parallel to the coil axis between the pole shoes and which generates a like polarization at the ends of the pole shoes.

2. Prior Art

A polarized relay is disclosed in U.S. Pat. No. 4,695,813, whose disclosure is incorporated herein by reference thereto and which claims priority from the same Japanese Application as European 0 197 391 B2. In this U.S. Patent, a polarized relay is disclosed, whose armature is carried by a pair of contact springs. Together with the armature, the contact springs are movable and are provided with a lever arm in their center areas that respectively extends transverse and is connected tightly to a terminal element at a base body. Thus, the lever arms are applied of one-piece to the contact springs and represent elastic torsion elements with a limited deformability. Given the relays of the U.S. Patent, the terminal tabs of the torsion spring webs are bent down and are connected to center contact terminal pieces in a recess in the base body. Thus, accessibility to the fastening points of the terminal tabs of the torsion spring web at the center contact terminal piece is difficult, whereby a simple and precise adjustment is impeded.

SUMMARY OF THE INVENTION

The present invention is directed to the object of creating a polarized relay with two changeover contacts, which polarized relay is characterized by a reduced overall height. Additional features are a simplified adjusting of the contact clearance and the armature stroke.

According to the present invention, these objects are achieved in that the coil is arranged above the armature, the contact springs comprise two spring arms and a connecting web, respectively, with the connecting web having a sheet metal plane extending perpendicular to the base plane, and the spring arms comprise a contact making part and a part embedded in the envelope, respectively, so that the part that is embedded in the envelope emerges into a connecting web and the fastening tabs are respectively fastened to a center contact terminal pin that extends perpendicularly out of the base body.

As a result of the inventive solution, it is possible to reduce the overall height of the polarized electromagnetic relays from approximately 10 mm to 5 mm. According to the preferred embodiment, the fastening tab is an extension of a terminal web that is bent in the direction of the coil. Preferably, the terminal web connects directly to the connecting web. However, it is also possible that the terminal web is connected via a leaf spring web to the spring arm of the contact spring, and this leaf spring web proceeds essentially parallel to the axis of the coil and has a sheet metal plane extending essentially parallel to the base plane. The terminal web and the fastening tab that is connected thereto preferably engage the center contact terminal pins. This contributes to a good accessibility of the fastening points and to an improved adjusting of the contact clearance. Preferably, the connection between fastening tabs and center contact terminal pins occurs through a resistance welding or a laser welding. During the assembly, the relay spring group can be introduced into the base body together with the armature from above with the help of the fastening tabs that have their sheet metal plane directed perpendicularly to the base plane. When the desired contact clearance is reached, the contact spring group is fastened to the base body together with the armature by welding the fastening tabs to the outer contact pins. When, during the installation, the contact spring group is intentionally introduced into the base body with the armature at an angle in a longitudinal direction, then a mechanical monostability of the relay can be preset. This is possible, for example, by choosing a smaller contact clearance at the break contacts than at the make contacts.

For the purpose of reducing the number of necessary relay component parts, each of the contact springs, which includes the connecting webs, the terminal webs and the fastening tabs, are preferably fabricated from a common sheet of metal. The same is valid for the terminal tracks for the stationary contact elements, whereby the terminal elements are formed by terminal tabs of the common sheet that are bent off perpendicularly.

In the advantageous embodiment of the invention, the envelope of the contact spring group exhibits a receptacle for the armature, so that the relay armature can be arranged between the contact springs and insulated therefrom. Thus, the relay armature is either glued to the envelope of the contact spring or is connected via vertical, deformed pegs of the envelope with the contact spring group. Preferably, the relay armature is fashioned planar, whereby a coupling piece is arranged between the armature and the at least one permanent magnet for the reduction of the magnetic resistance in the magnetic circuit. The coupling piece can either be fastened to the magnet by a laser welding or can be held in an envelope of the coil. An additional reduction in the overall height of the relay results when the armature, from its center area, is bent toward the pole shoes by roughly half of the lifting angle.

In a further embodiment of the invention, the spring arms have contact pieces of profile material welded on them. Preferably, the stationary contact elements are welded on the terminal tracks. A space-saving twin contacting can be achieved when the stationary contact elements are respectively doubly realized and when a movable contact element respectively overlaps two stationary contact elements.

Advantageously, the coil, together with the core and the pole shoes is surrounded by an insulating envelope, and the base of the relay is fashioned by the base body, which accepts the armature and the contact spring group. The insulating envelope together with the bottom side of the base body forms a housing for the relay. When finishing such a relay, the coil that is surrounded by the insulating envelope is pushed onto the base body until the desired armature stroke is reached. Then, the insulating coating of the coil clamps on the pedestal and the relay can be subsequently sealed with a casting resin.

Other advantages and features of the invention will be readily apparent from the following description of the preferred embodiments, the drawings and claims.

DESCRIPTION OF THE PREFERRED EMBODIMENTS

Figure 1:
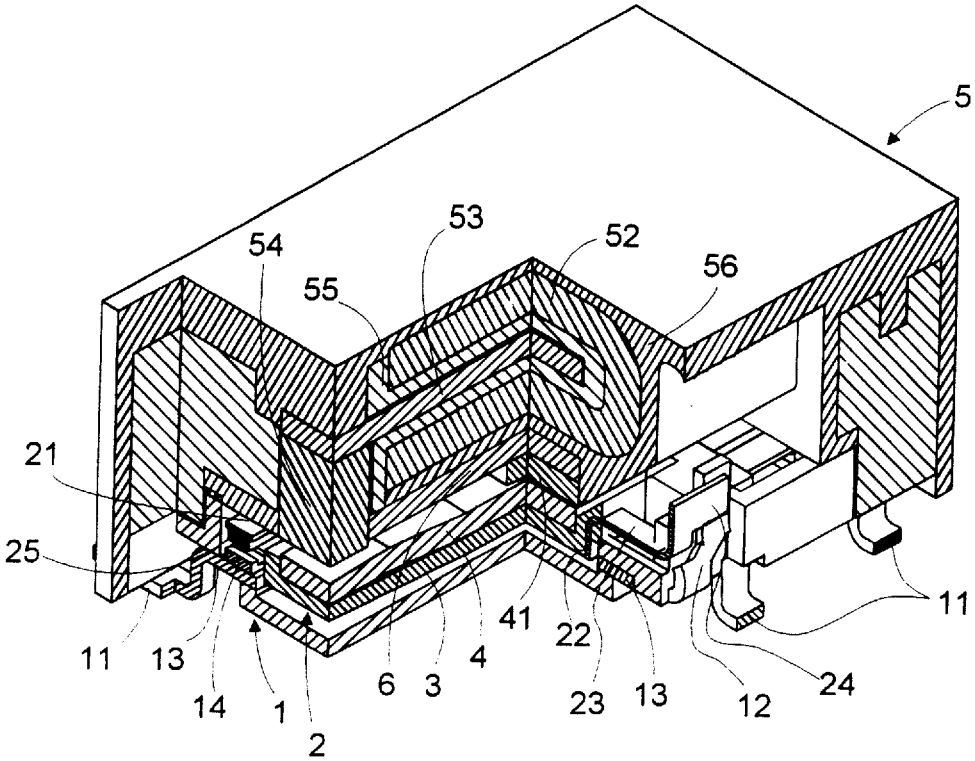
FIG. 1 is an axonometrical sectional view of the relay of the present invention.
Figure 2:
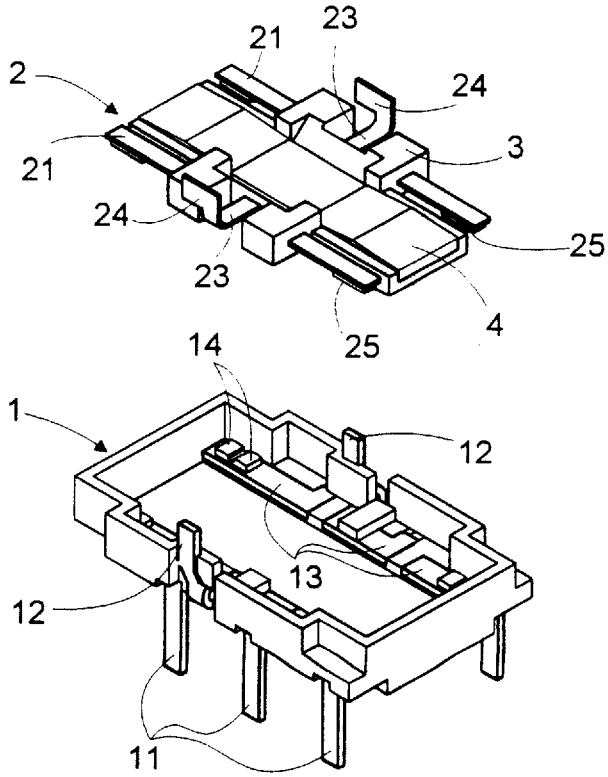
FIG. 2 is an exploded view of a base body and a contact spring group together with the armature of the relay of the present invention.
Figure 4:
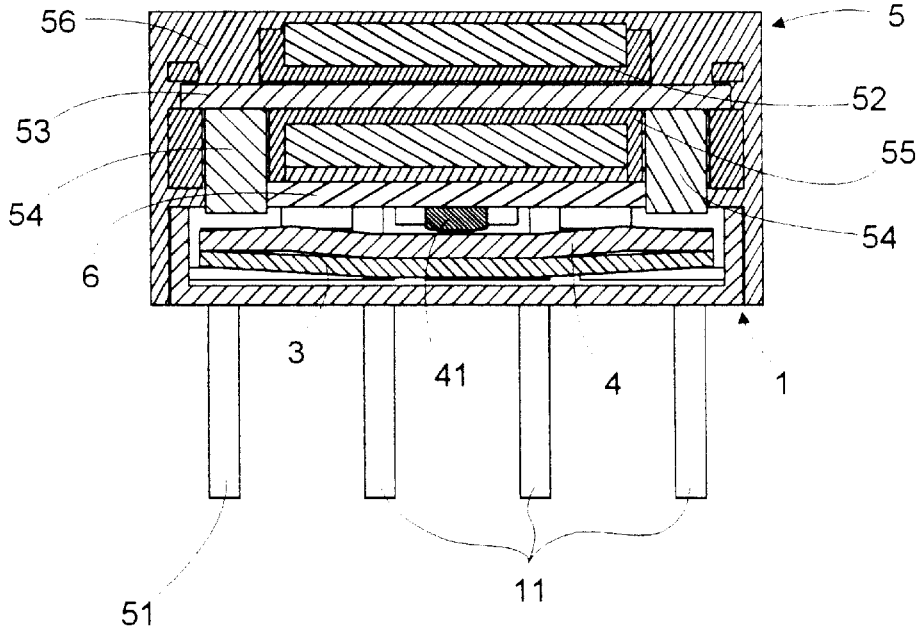
FIG. 4 is a longitudinal sectional view of the relay.

The principles of the present invention can be obtained in a relay illustrated in FIG. 1, which has a housing fashioned by a bottom side of a pedestal or base member 1 and an insulating envelope 56 of a coil 5 that is pushed over the base member 1. Preferably, the envelope 56 is fashioned by extrusion-coating of the coil 5. Contact terminal elements 11 and winding terminal elements 51 extending through the bottom side of the base member that represents the base plane of the relay, as illustrated in FIGS. 1 and 4. A contact spring group 2 and an armature 4 are arranged above the base member 1 and below the coil 5. As also shown in FIG. 2, the contact spring group 2 exhibits an envelope 3 that is composed of an insulating material, in which two contact springs 20 are embedded to lie parallel to one another in a common plane.

Figure 3:
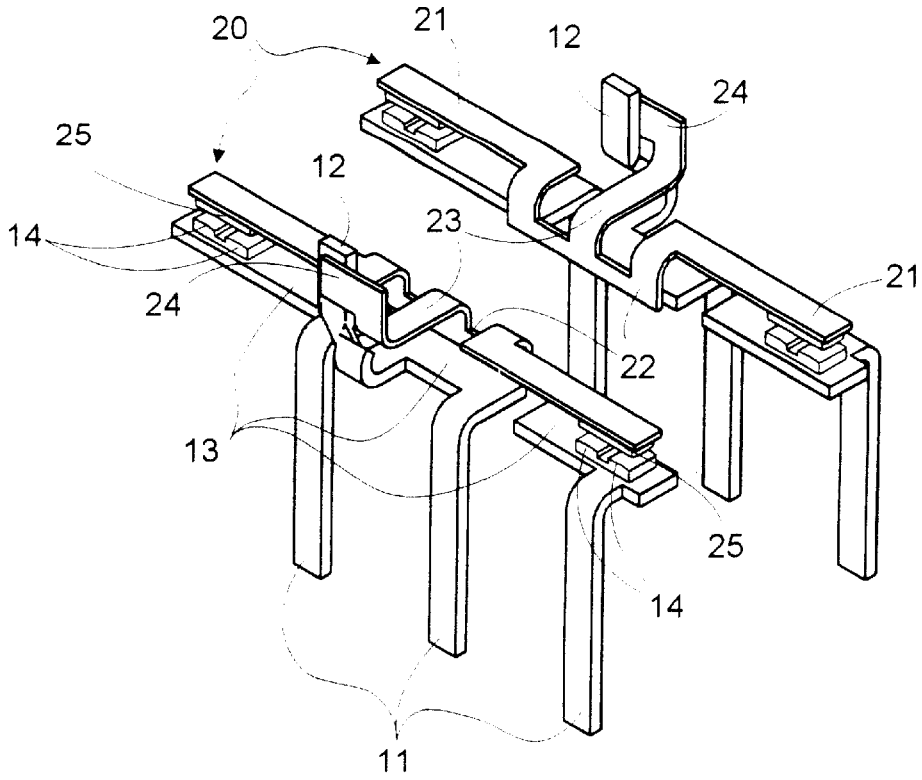
FIG. 3 is a perspective view of the contact springs and terminal tracks and terminal elements which are embedded in the base body of FIG. 2.

Preferably, the envelope 3 is fashioned as an extrusion-coating of the contact springs 20. Each contact spring 20 includes a connecting web 22 and two spring arms 21. Contact making ends of the spring arms 21 extend out of the envelope 3 and the spring arms 21 have contact pieces 25 of a profile material welded on the free ends. The parts of the spring arms 21 that are embedded in the envelope 3 directly merge into a connecting web 22, as best illustrated in FIG. 3. In addition, the envelope 3 exhibits a receptacle for the armature 4, whereby the armature is arranged to be insulated between the two relay springs 20.

A core 53, to whose ends pole shoes 54 are directed toward the armature 4 to form a connect, is arranged axially in the coil 5. A bar-shaped three-pole permanent magnet 6 is arranged parallel to the axis of the coil between the pole shoes 54 to generate a like polarization S at the ends of the pole shoes 54, as best illustrated in FIGS. 1 and 4.

In order to reduce the magnetic resistance between the armature 4 and the permanent magnet 6, a coupling piece 41, as best illustrated in FIG. 4, is arranged between the armature 4 and the magnet 6 in the area of the rotational axis of the armature. Given a relay according to FIG. 1, the terminal elements 11 for the relay elements 14 and 25 are realized as surface mounted technology-terminal contacts or SMT-terminal pads or contacts. However, they can also be constructed as insert pins, as indicated in FIG. 4.

The base member 1 that is composed of insulating material has terminal tracks 13 for stationary contact elements 14 that are manufactured from a common sheet metal embedded in it. The stationary contact elements 14 are welded on the terminal tracks 13. The contact terminal elements 11 are fashioned as bent-down tabs of the common sheet for the terminal tracks 13, as illustrated in FIG. 3. The same is valid for the center contact terminals, which are fashioned by bent-off tabs of the terminal tracks. The center contact terminal pins 12 are fashioned by terminal tabs that are bent upward, while the terminal elements 11 of the center contacts are bent downward and extend through the bottom side of the base member 1.

With the help of FIGS. 2 and 3, it can be seen that the contact spring group 2 comprises two contact springs 20, which are separated from each other and run parallel in the same plane. The contact springs 20 have spring arms 21 which carry switch contacts 25 that are welded to the free end of the arms. The contact springs 20 are prefabricated from a common sheet of metal and are surrounded in their center section by the insulating envelope 3. Apart from the contact making ends of the spring arms 21, two transverse terminal webs 23 extend out of the envelope 3 in the area of the rotational axis of the armature, which have their sheet metal plane extending parallel to the base plane. Moreover, the contact spring group 2 exhibits two fastening tabs 24, which have their sheet metal plane extending perpendicular to the base plane. The fastening tab 24 is respectively fastened to a center contact terminal pin 12, which extend perpendicularly out of the base member 1 and is connected to the contact spring via the terminal webs 23. The connecting web 22 is surrounded entirely by the insulating envelope 3 and has its sheet metal plane extending perpendicular to the base plane, as best illustrated in FIG. 3.

Since the center contact terminal pins 12 and the fastening tabs 24 exhibit welding surfaces, which lie next to one another in a plane that is perpendicular to the base plane, the contact spring group 2 can be introduced into the base member 1 together with the armature 4 from above during the assembly operation. When a desired contact clearance is reached, the fastening tab 24 that engages the center contact terminal pins 12 is welded thereto at the welding surfaces of the center contact terminal pins. The contact pieces 25 that are welded on the contact making ends of the spring arms 21 respectively overlap two stationary contact elements 14. With reference to FIG. 3, it can be seen that the terminal webs 23 connect to the connecting webs 22 in the area of the armature. To that end, it would be alternatively possible to respectively connect the terminal webs 23 via a leaf spring web to the spring arm 21 of the contact spring 20 and the leaf spring web proceeds essentially parallel to the axis of the coil and has its sheet metal plane extending parallel to the base plane. As illustrated in FIG. 4, the ends of the armature 4 are bent slightly upward toward the pole pieces 54 to contribute to additional reduction in the overall height of the relay.

In addition, during the assembly, the desired armature stroke is easily adjustable. To that end, the coil 5 as well as the core 53 and the pole shoes 54 that are also surrounded by the insulating envelope 56 as well as the permanent magnet 6 that is arranged below the coil 4 are pushed on the base member 1, which is equipped with the contact spring group 2 and the armature 4 until the desired armature stroke is obtained. Then, the envelope 56 of the coil has a bottom edge clamping on the base member 1. With the help of a magnetic equalization, it is ensured that the relay response to the desired voltage respectively falls back.

Although various minor modifications may be suggested by those versed in the art, it should be understood that we wish to embody within the scope of the patent granted hereon all such modifications as reasonably and properly come within the scope of our contribution to the art.

We claim:

1. A polarized electromagnetic relay having a base body comprising an insulating material which defines a base plane with a bottom side and in which terminal tracks for stationary contact elements as well as terminal elements for stationary and movable contact elements are embedded, a pivotable armature being arranged above the base body with a rotational axis extending parallel to the base plane and being arranged between two contact springs of a contact spring group that is connected to the armature, said contact springs being arranged in a common plane and extending parallel to each other and the contact springs cooperate with the stationary terminal elements of the base body corresponding to the movement of the armature, an envelope of an insulating material which surrounds the contact springs in a center sector and from which two transverse terminal webs are connected with the contact spring and project in the area of the rotational axis of the armature, whereby the terminal webs are respectively connected with a fastening tab, which has its sheet metal plane extending perpendicular to the base plane, a coil whose axis runs parallel to the base plane and perpendicular to the rotational axis of the armature and whose winding terminal elements extend perpendicular through the base plane, a core being arranged in the coil and to whose ends pole shoes that are directed toward the armature connect and which form at least one working air gap with the armature and at least one bar-shaped permanent magnet which is arranged parallel to the coil axis between the pole shoes and which generates a like polarization at the ends of the pole shoes, the improvements comprising the coil being arranged above the armature, the contact springs exhibiting two spring arms and a connecting web, respectively, the connecting web having a sheet metal plane extending perpendicular to the base plane, each of the spring arms having respectively one contact making part and one part that is embedded in the envelope, wherein the part that is embedded in the envelope emerges into a connecting web and the fastening tabs are respectively fastened to center contact terminal pins and extending perpendicularly out of the base body.

2. A relay according to claim 1, wherein the fastening tab represents an extension of a terminal web that is bent toward the coil.

3. A relay according to claim 1, wherein each of the terminal webs connects directly to the connecting web.

4. A relay according to claim 1, wherein the terminal webs and the fastening tabs that are connected thereto encompass a spring contact pin.

5. A relay according to claim 1, wherein the contact spring includes a connecting web, a terminal tab and a fastening tab being fabricated from one common sheet of metal.

6. A relay according to claim 1, wherein the envelope of the contact spring group exhibits a receptacle for the armature.

7. A relay according to claim 1, wherein the armature is glued to the envelope of the contact spring group.

8. A relay according to claim 1, wherein the armature is fashioned planar and a coupling piece is arranged between the armature and the at least one permanent magnet.

9. A relay according to claim 8, wherein the armature, from a center area is bent by roughly a half stroke angle toward the pole shoes.

10. A relay according to claim 1, wherein the terminal tracks for the stationary contact elements are fabricated from a common sheet and the terminal elements are formed by terminal tabs of the sheet being bent perpendicular to the plane of the sheet.

11. A relay according to claim 1, wherein the spring arms have contact pieces of a profile material welded thereon.

12. A relay according to claim 1, wherein the fastening tabs are welded to the center contact pins.

13. A relay according to claim 1, wherein the stationary contact elements are welded to the terminal tracks.

14. A relay according to claim 1, wherein the stationary contact elements are respectively implemented doubled.

15. A relay according to claim 1, wherein the base body, which accepts the armature and the contact spring group, forms a base member of the relay, the coil together with the core and the pole shoes being surrounded by an insulating envelope, said insulating envelope together with the bottom side of the base member forming a housing for the relay.

16. A relay according to claim 1, wherein a winding terminal element and a terminal element for the stationary and movable contact elements are realized as SMT-terminal contacts.

17. A relay according to claim 1, wherein the winding elements and terminal elements for stationary and movable contact elements are realized as insert pins.

* * * * *